US005301409A

United States Patent [19]

Laframboise

[11] Patent Number: 5,301,409

[45] Date of Patent: Apr. 12, 1994

[54] APPARATUS FOR SETTING A CIRCULAR COMPONENT INTO A CLOSE FITTING CIRCULAR OPENING

[76] Inventor: Oliver Laframboise, Box 206, Legal, Alberta, Canada, T0G 1L0

[21] Appl. No.: 36,942

[22] Filed: Mar. 25, 1993

[30] Foreign Application Priority Data

Mar. 27, 1992 [CA] Canada ..... 2064293

[51] Int. Cl.[5] ..... B25B 27/14

[52] U.S. Cl. ..... 29/275

[58] Field of Search ..... 29/275, 254, 255, 261, 29/263, 282

[56] References Cited

U.S. PATENT DOCUMENTS

| | | | |
|---|---|---|---|
| 2,521,011 | 9/1950 | Hoskins . | |
| 2,718,801 | 9/1955 | Finley . | |
| 2,732,741 | 1/1956 | Nykker-Strobel . | |
| 2,861,330 | 11/1958 | Kratz | 29/254 |
| 3,336,652 | 8/1967 | Ullmo | 29/254 |
| 4,033,205 | 7/1977 | Hoskins . | |
| 4,229,870 | 10/1980 | Tate | 29/254 |
| 4,429,447 | 2/1984 | Davis | 29/275 |
| 5,090,102 | 2/1992 | Lovell | 29/255 |
| 5,181,303 | 1/1993 | Gregg | 29/255 |

FOREIGN PATENT DOCUMENTS

| | | |
|---|---|---|
| 651139 | 10/1962 | Canada . |
| 1078151 | 5/1980 | Canada . |
| WO91/01854 | 2/1991 | PCT Int'l Appl. . |

OTHER PUBLICATIONS

IBM Technical Disclosure Bulletin vol. 17, No. 2, Jul. 1974 Pluggable Module Extraction Tool.

*Primary Examiner*—Robert C. Watson

*Attorney, Agent, or Firm*—Davis, Bujold & Streck

[57] ABSTRACT

An apparatus for setting a circular component into a close fitting circular opening consists of an elongate body having a longitudinal axis. One end of the body engages a circular component adjacent a circumference of the circular component, such that the circular component is centred upon and maintained transverse to the longitudinal axis and is supported evenly around the circumference. An anvil is centered on the longitudinal axis at an opposed end of the body. A blow delivered to the anvil passes along the longitudinal axis causing a setting force to be exerted evenly upon the circumference of the circular component.

3 Claims, 3 Drawing Sheets

APPARATUS FOR SETTING A CIRCULAR COMPONENT INTO A CLOSE FITTING CIRCULAR OPENING

The present invention relates to an apparatus for setting a circular component into a close fitting circular opening.

BACKGROUND OF THE INVENTION

It is difficult to set a circular component into a close fitting circular opening as, unless care is taken to exert pressure evenly, the circular component will bind in the opening. The present invention was developed primarily for use in the automotive field. There are many applications in the automotive field in which circular components must be fit into a close fitting circular opening. Examples of such applications are the setting of axle caps, the setting of seals with circular housings and the setting of bearings. With seals and bearings great care must be exhibited as they can be damaged by excessive force. If the circular housing of a seal is damaged it will leak. If the race of a bearing is damaged, there will not be free movement of the bearings. With axle caps, the concern is not so much that of damaging the axle caps but of the time it takes to correctly set them. Axle caps have a radially projecting circumferential rim. Installation is presently effected by carefully tapping along the circumference of the rim to gradually work the axle cap into the opening.

SUMMARY OF THE INVENTION

What is required is an apparatus which can be used for setting a circular component into a close fitting circular opening.

According to the present invention there is provided an apparatus for setting a circular component into a close fitting circular opening which is comprised of an elongate body having a longitudinal axis. Means is provided at one end of the body for engaging a circular component adjacent a circumference of the circular component, such that the circular component is centred upon and maintained transverse to the longitudinal axis and is supported evenly around the circumference. An anvil is centred on the longitudinal axis at an opposed end of the body. A blow delivered to the anvil passes along the longitudinal axis causing a setting force to be exerted evenly upon the circumference of the circular component.

The invention as described both speeds up the installation of a circular component and reduces the chance of damaging the circular component during installation. The means used to engage the circular component will vary with the type of circular component. For example, an axle cap must be grabbed around its circumference, by a close fitting ring or evenly spaced gripping fingers. With the apparatus as described the axle cap can be set by one or two blows rather than a plurality of taps around the circumferential rim. In contrast, a magnetic ring must be used to grip a metallic side of seals and bearings. The force of any blow is distributed equally around the magnetic ring, as localized fore can cause damage.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
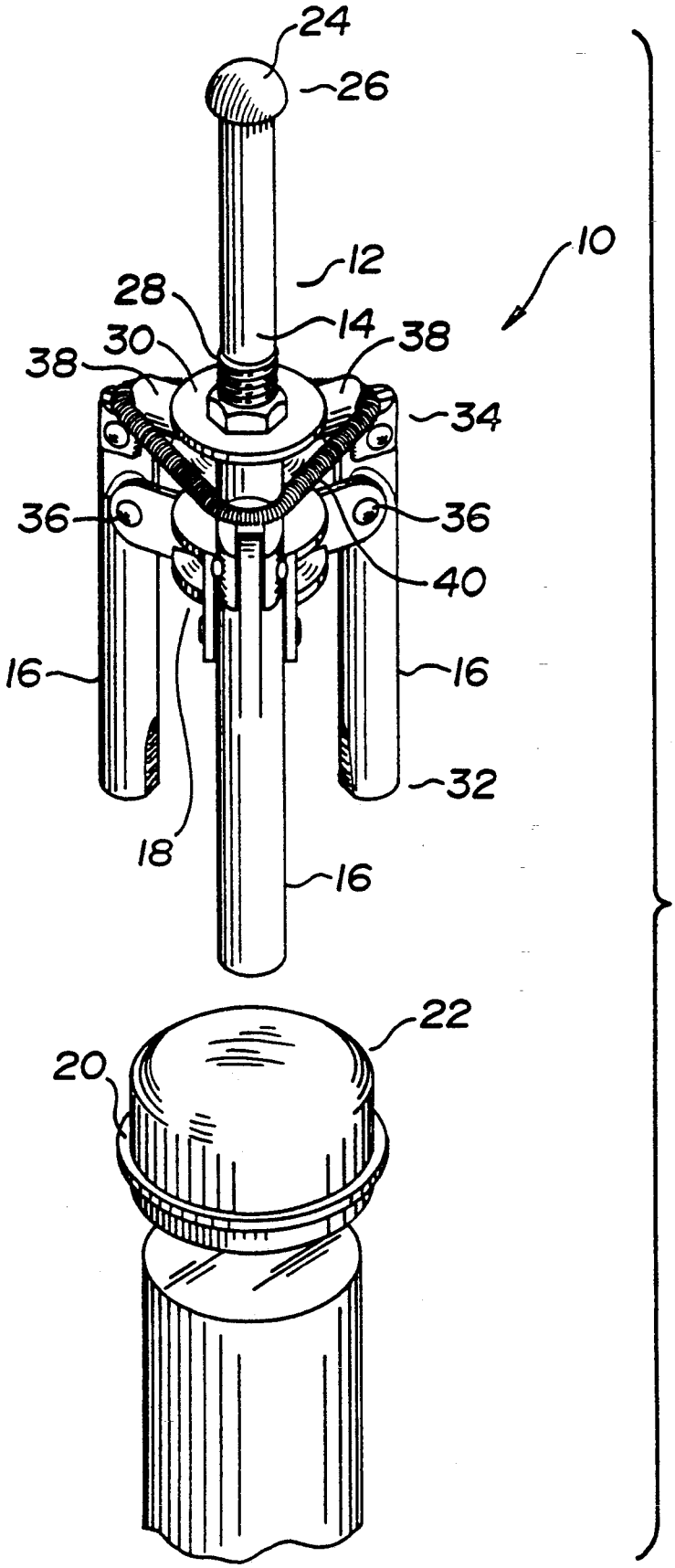
FIG. 1 is a perspective view of an apparatus for setting circular components constructed in accordance with the teachings of the present invention.

The preferred embodiment, an apparatus for setting a circular components into a close fitting circular opening generally identified by reference numeral 10, will now be described with reference to FIGS. 1 through 4.

Figure 2:
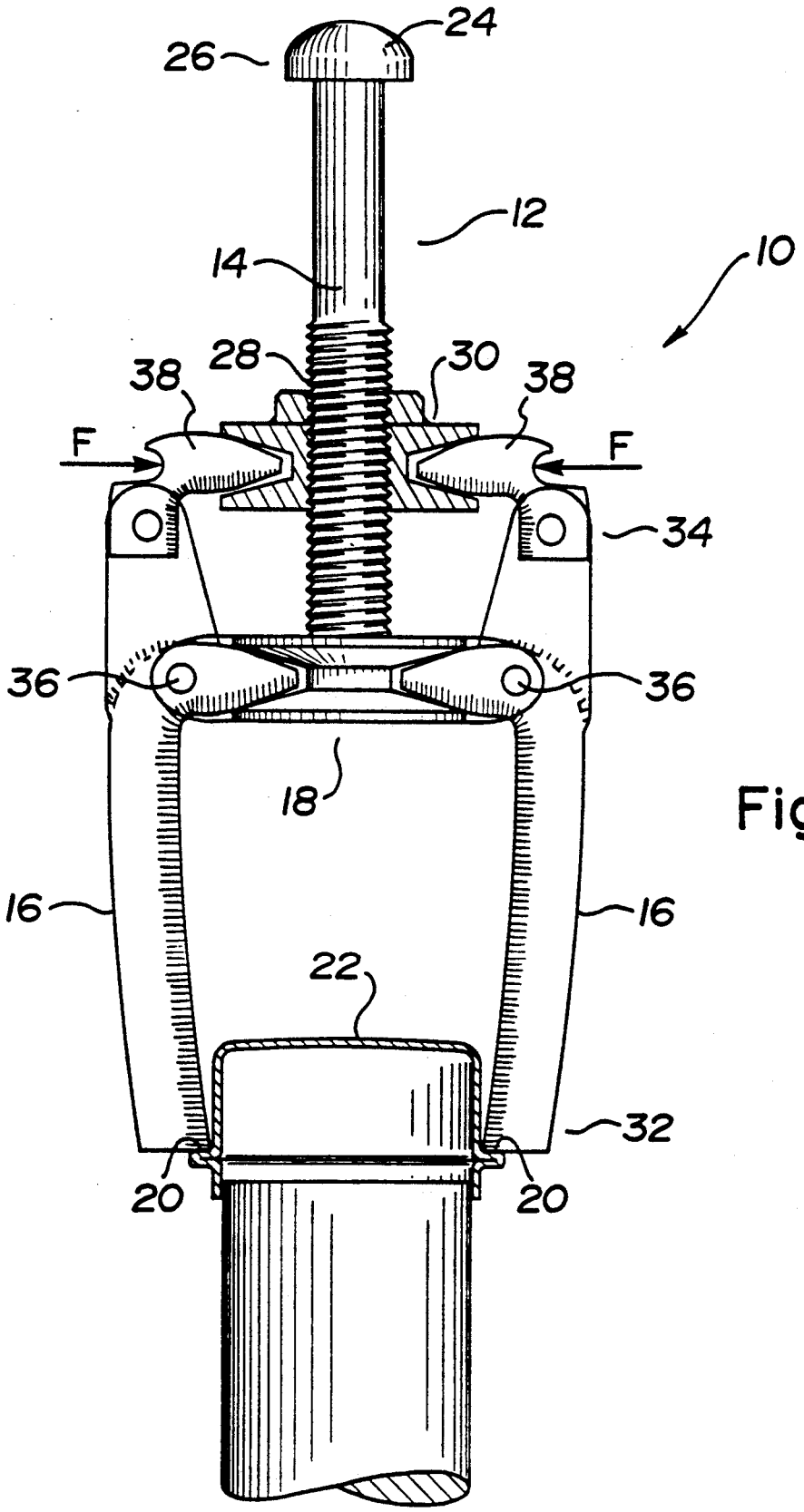
FIG. 2 is a side elevation view of the apparatus for setting circular components illustrated in FIG. 1.

Referring to FIGS. 1 and 2, apparatus 10 consists of an elongate body 12 having a longitudinal axis 14. Three gripping fingers 16 are spaced equidistant to longitudinal axis 14 at one end 18 of body 12. Gripping fingers 16 which are adapted to engage a circumference 20 of a circular component, which in FIGS. 1 and 2 is an axle cap 22. It is to be noted that axle cap 22 is centred upon and maintained transverse to longitudinal axis 14 and is supported evenly around circumference 20 by gripping fingers 16. An anvil 24 is centred on longitudinal axis 14 at an opposed end 26 of body 12.

In the first prototype of the invention which was constructed gripping fingers 16 were fixed. It is preferred that means be provided to permit the adjustment of gripping fingers 16 to accommodate different sizes of circular components; in this case different sizes of axle caps 22. Elongate body 12 has external threads 28. A sheave 30 is rotatably secured to threads 28, such that upon rotation of sheave 30 the sheave moves axially long longitudinal axis 14. Each of gripping fingers 16 have a gripping end 32 and an adjustment end 34. Each gripping finger 16 is being pivotally mounted to end 18 of body 12 at pivot point 36 which is intermediate gripping end 32 and adjustment end 34. Adjustment end 34 of gripping fingers 16 has a projection 38 which is biased by spring 40 into engagement with sheave 30.

Figure 3:
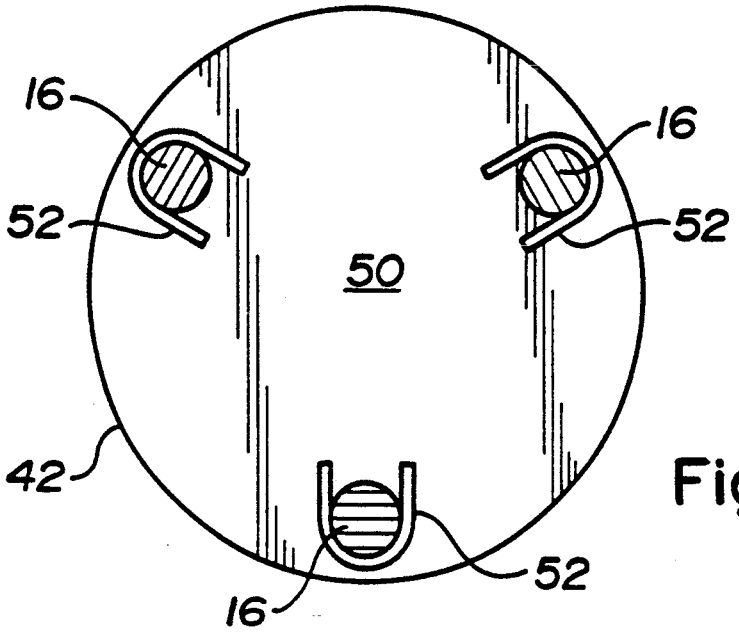
FIG. 3 is a transverse section view of the apparatus illustrated in FIG. 1, with ring attachment.
Figure 4:
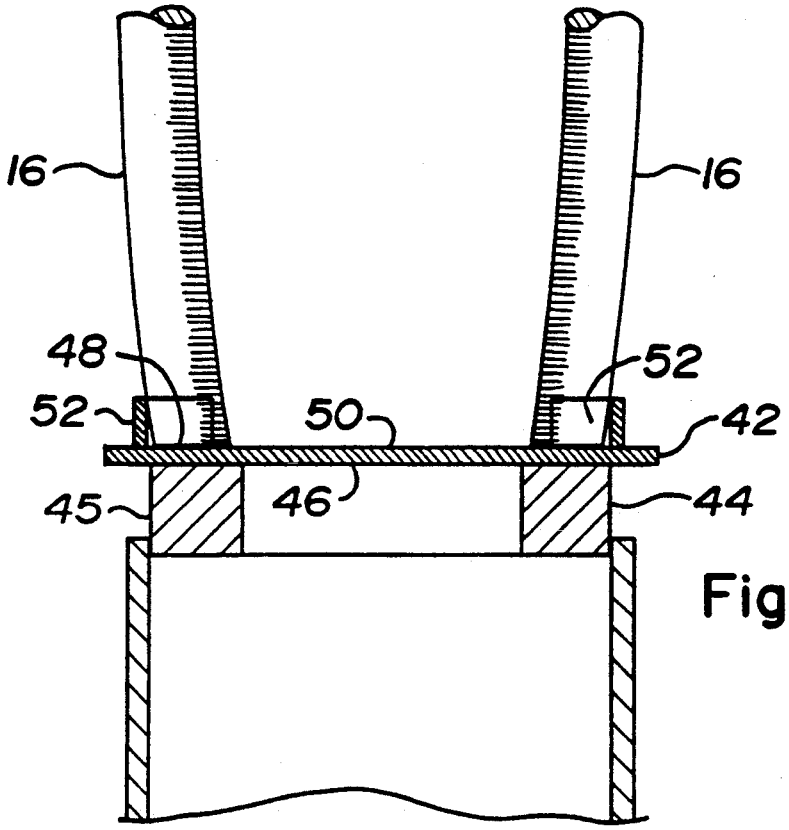
FIG. 4 is a longitudinal section view of the apparatus illustrated in FIG. 1, with ring attachment.

Referring to FIGS. 3 and 4, apparatus 10 can be used in combination with a magnetic ring 42. Magnetic ring 42 was developed for use as a means for engaging circular components, such as seal ring 44 for it is not practical to directly engage circumference 45 of seal ring 44. Magnetic ring 42 has one face 46 which is adapted to engage a metallic face 48 of seal ring 44. An opposed face 50 of magnetic ring 42 has three sockets 52 which matingly receive gripping end 32 of gripping fingers 16. When gripping fingers 16 are engaged in sockets 52 magnetic ring 42 is centred upon and maintained transverse to longitudinal axis 14 and is supported evenly by gripping fingers 16.

The use and operation of apparatus 10 will now be described with reference to FIGS. 1 through 4. The user first must determine what means are best suited for engaging the particular circular component with which he is working. A circular component, such as seal ring 44 is best installed using magnetic ring 42. Referring to FIG. 3 and 4, magnetic ring 42 is secured to apparatus 10 by inserting gripping end 32 of gripping fingers 16 into sockets 52. Metallic face 48 of seal ring 44 is then secured by magnetic attraction to magnetic face 46 of magnetic ring 42. A circular component, such as axle cap 22 is best installed using gripping fingers 16. As there are a variety of sizes of axle caps 22, gripping fingers 16 must be adjusted to suit the size of axle cap 22 selected. Referring to FIGS. 1 and 2, adjustment is effected rotation of sheave 30. Upon rotation of sheave 30, the sheave moves axially along longitudinal axis 14. Due to the engagement between projection 38 at adjustment end 34 of gripping fingers 16 and sheave 30, gripping fingers 16 move with sheave 30. The movement is about pivot point 36. It is important that gripping fingers 16 not alter their adjustment during use. Sheave 30 will not move axially as a result of a jarring blow or through inadvertence as sheave 30 is in threaded engagement with external threads 28 on elongate body 12 and must be rotated in order to move. Gripping fingers 16 will not move as a result of a jarring blow or through inadvertence as they are locked in engagement with sheave 30. Once the circular component is secured to end 18 of body 12, the circular component is placed in the desired alignment. A blow is then delivered to anvil 24 by means of a hammer. The blow passes along longitudinal axis 14 causing a setting force to be exerted evenly adjacent the circumference of the circular component.

It will be apparent to one skilled in the art that modifications may be made to the illustrated embodiment without departing from the spirit and scope of the invention as defined by the claims.

The embodiments of the invention in which an exclusive property or privilege is claimed are defined as follows:

1. An apparatus for setting a circular component into a close fitting circular opening, comprising:

a. an elongate body having a longitudinal axis;

b. means at one end of the body for engaging a circular component adjacent a circumference of the circular component, such that the circular component is centred upon and maintained transverse to the longitudinal axis and is supported evenly around the circumference, the means for engaging the circular component being a magnetic ring which is adapted to engage a metallic face of the circular component; and c. an anvil centred on the longitudinal axis at an opposed end of the body, whereby a blow delivered to the anvil passes along the longitudinal axis causing a setting force to be exerted evenly adjacent the circumference of the circular component.

2. The apparatus for setting a circular component into a close fitting circular opening, comprising:

a. an enlongate body having a longitudinal axis;

b. at least three gripping fingers spaced equidistant to the longitudinal axis at one end of the body and which are adapted to engage a circumference of a circular component, such that the circular component is centred upon and maintained transverse to the longitudinal axis and is supported evenly around the circumference; and c. an anvil centred on the longitudinal axis at an opposed end of the body, whereby a blow delivered to the anvil passes along the longitudinal axis causing a setting force to be exerted evenly adjacent the circumference of the circular component; in combination with d. a magnetic ring having one face which is adapted to engage a metallic face of the circular component, and an opposed face having sockets which matingly receive the gripping fingers, such that the magnetic ring is centred upon and maintained transverse to the longitudinal axis and is supported evenly by the gripping fingers.

3. The apparatus for setting a circular component into a close fitting circular opening, comprising:

a. an elongate body having a longitudinal axis;

b. at least three gripping fingers spaced equidistant to the longitudinal axis at one end of the body and which are adapted to engage a circumference of a circular component, such that the circular component is centred upon and maintained transverse to the longitudinal axis and is supported evenly around the circumference;

c. an anvil centred on the longitudinal axis at an opposed end of the body, whereby a blow delivered to the anvil passes along the longitudinal axis causing a setting force to be exerted evenly adjacent the circumference of the circular component; and d. the elongate body having threads, a sheave being rotatably secured to the threads of the elongate body such that upon rotation of the sheave, the sheave moves axially along the longitudinal axis, the gripping fingers having a gripping end and an adjustment end, the gripping fingers being pivotally mounted to the one end of the body intermediate the gripping end and the adjustment end, and the adjustment end of the gripping fingers having a projection which is biased into engagement with the sheave, such that the gripping fingers are adjustable to suit a variety of sizes of circumference by rotation of the sheave.

* * * * *